US005535764A

United States Patent [19]

Abramson

[11] Patent Number: 5,535,764

[45] Date of Patent: Jul. 16, 1996

[54] PRODUCT AND PROCESS FOR HIGHLIGHTING HAIR

[75] Inventor: Kevin G. Abramson, Brockton, Mass.

[73] Assignee: Plitek, Inc., Des Plaines, Ill.

[21] Appl. No.: 206,206

[22] Filed: Mar. 3, 1994

Related U.S. Application Data

[63] Continuation of Ser. No. 987,060, Dec. 7, 1992, abandoned, which is a continuation of Ser. No. 750,957, Aug. 28, 1991, abandoned, which is a continuation-in-part of Ser. No. 659,846, Feb. 22, 1991, Pat. No. 5,056,539.

[51] Int. Cl.[6] ..... A45D 20/08; A45D 2/00

[52] U.S. Cl. ..... 132/200; 132/222; 132/270

[58] Field of Search ..... 132/208, 220, 132/221, 222, 270

[56] References Cited

U.S. PATENT DOCUMENTS

| | | | |
|---|---|---|---|
| 2,139,311 | 12/1938 | Aldworth | 132/221 |
| 3,800,811 | 4/1974 | Esposto | 132/270 |
| 4,196,741 | 4/1980 | Minghenelli | 132/222 |
| 4,224,954 | 9/1980 | Stahl | 132/208 |
| 4,672,983 | 6/1987 | Nath et al. | 132/208 |
| 5,007,443 | 4/1991 | Fulgoni | 132/222 |
| 5,056,538 | 10/1991 | Matula | 132/208 |

FOREIGN PATENT DOCUMENTS

| | | | |
|---|---|---|---|
| 0126618 | 11/1984 | European Pat. Off. | 132/208 |

*Primary Examiner*—John G. Weiss
*Attorney, Agent, or Firm*—Arthur A. Smith, Jr.

[57] ABSTRACT

A product and method for highlighting and/or coloring selective areas of hair on a person's head is disclosed, which is particularly useful for persons with dark hair and for hair that takes longer to dry and hence develop. The invention is an improved product for and method of foiling hair to achieve highlighting.

12 Claims, 6 Drawing Sheets

PRODUCT AND PROCESS FOR HIGHLIGHTING HAIR

This is a continuation of application(s) Ser. No. 07/987,060 filed on Dec. 7, 1992 now abandoned, which is a continuation of Ser. No. 07/250,957 which was filed on Aug. 28, 1992 now abandoned, which is a continuation-in-part of application U.S. Ser. No. 659,846 filed Feb. 22, 1991 now U.S. Pat. No. 5,056,539.

FIELD OF THE INVENTION

The present invention relates generally to the field of hair styling and more specifically to techniques for bleaching and/or coloring selective areas of hair on a person's head, while leaving other areas untouched, such techniques being known in the profession as "highlighting". The invention more specifically relates to a new, improved product and method for "highlighting" hair, especially hair that is darker or hair that requires longer than usual to develop, through "foiling" which is faster, more efficient and less expensive than existing methods and products.

BACKGROUND OF THE INVENTION

In hair styling, selective bleaching or coloring of a client's hair is known by a number of names, including, "highlighting" or "frosting". There are three generally recognized methods of highlighting, that is, cap highlighting, combing, and foiling. A description of cap highlighting and combing, along with the disadvantages thereof, are described in the applicant's aforementioned pending application.

In the third commonly employed method, called foiling, the hair stylist utilizes pieces of foil material, usually of the ordinary kitchen variety, cut into square or rectangular pieces. The segments of hair to be highlighted are pulled forward, placed on the foil, and colored or bleached. The foil is then folded in half, sandwiching the hair segments, between the top and bottom halves. This procedure is repeated for each segment to be highlighted.

The existing method of foiling suffers from a number of disadvantages. The bottom half of the folded foil must be held against the head while the segment of hair is being painted with the liquid. There is a tendency for the foil to move or slip, causing the color or bleach to spill over or "bleed" onto those segments of hair not intended to be highlighted. The result is often a spotted, uneven effect.

Additionally, the existing method of foiling often results in uneven coloring or bleaching of the hair due to another factor. In foiling, it is difficult to accurately control setting time. For example, the hair stylist will typically begin the application on the back of the head moving toward the front (or, vice versa). Because the present method is so cumbersome it is also very time consuming. Hence, those segments of hair initially colored or bleached (e.g., in the back) will set to the desired shade well before those segments finally colored or bleached (e.g., in the front). The stylist must therefore continuously check on each foiled segment while continuing to apply the color or bleach to other segments in order to avoid uneven coloring or bleaching over the head surface.

In practice, the hair stylist continuously opens and closes foiled segments, to visually observe the state of coloration. Each time a foiled segment is opened and closed there exists the risk of bleeding or of the foil disengaging from the hair if the liquid has not had enough time to set. Continuous opening and closing of the foil tends to loosen its hold on all or portions of the hair segment, causing the foil to detach from the hair or portions of the hair to escape from the foil. The result is uneven coloring/bleaching.

Further, the hair stylist is unable at any moment during the process to have a visual over-view of all of the highlighted segments. Consequently, it is difficult to precisely control the process to ensure an even coloring or bleaching throughout.

In the referenced pending application, the applicant describes a quicker, more efficient, easier and more comfortable application method of foiling, utilizing aluminum foil pre-cut to a standard sized sheet having a fold on the two opposing ends. The segment of foil has two window panes covered with a transparent material such as cellophane. The window panes are equidistant from each other on the foil such that when the foil segment is folded in half, one window pane is aligned on top of the other, thereby allowing a clear view through the folded segment. No-slip adhesive is affixed to one of the aforementioned folds at one end of the segment.

The stylist pulls out a segment of hair, places the foil against the head under the hair segment, such that the end with the no-slip adhesive is against the head. The stylist then rests the hair segment on the foil sheet over one of the window panes. The hair segment is gently held in place by the adhesive while the color or bleach is applied. The foil sheet is then folded in half such that the two window panes are aligned, allowing a clear view of the sandwiched hair from top or bottom. The folded foil sheet is held in place by the no-slip adhesive which also prevents bleeding at the end. Bleeding is also prevented by folding the foil along its two sides ("Bleeding" is the term used in the art to describe the seepages of the color or bleach through or out of the foiling material onto other hair strands, causing an uneven or spotted look).

The use of no-slip adhesive ensures that the foil remains in place, prevents bleeding, and allows the process to be applied much quicker than the previous techniques. Further, the window panes allow the stylist to continuously check on the setting of the color or bleach without continuously opening and closing the foil segments. The stylist can now remove individual foil pieces when the desired shade is attained, thus achieving an even coloration over all highlighted segments of the head. Where more than one shade is desired, the foil can be color coded to distinguish the different shades. The no-slip adhesive allows the foil to be easily and quickly removed without discomfort to the client.

SUMMARY OF THE INVENTION

In the present invention, applicant has made an improvement to the product and process described in the aforementioned pending application, which improvement works especially well with darker hair or with hair that normally requires a longer than usual developing time.

Aluminum foil is pre-cut to a standard sized sheet having a fold on at least one end. The segment of foil has at least one window pane covered with a transparent material such as cellophane. At least one window pane is located on the sheet in such a way that when the sheet is folded in half along the horizontal plane, the at least one window pane is aligned over a segment of foil.

The stylist pulls out a segment of hair, places the foil against the head under the hair segment, such that the end with the no-slip adhesive is against the head. That stylist then rests the hair segment on the foil sheet. The hair segment is gently held in place by the adhesive while the color or bleach is applied. The foil sheet is then folded in half so that the at least one window pane is aligned over all or a substantial portion of the hair segment to be colored or bleached, allowing a clear view of the sandwiched hair segment. The folded foil sheet is held in place by the no-slip adhesive which also prevents bleeding at the end. Bleeding is also prevented by folding the foil along its two sides.

The no-slip adhesive ensures that the foil remains in place, preventing bleeding, and allows the process to be applied much quicker than existing techniques. The at least one window pane allows the stylist to continuously check on the setting of the color or bleach without continuously opening and closing the foil segments.

For darker hair or hair that may require longer than usual developing time, this improvement works especially well since the window-over-foil relationship, sandwiching the hair segment, creates an even, quicker and constantly observable developing effect. Sandwiching the hair segment between the foil and the window creates additional heat on the hair segment because of the oil, but allows the coloring to be observed continously because of the window pane.

The invention is not limited to one window. Any number, shape and size of window panes may be used provided only that when the foil sheet is folded, a window pane is always aligned over a foil segment and not over another window pane, and, secondly, that substantially all of the hair being colored or bleached is sandwiched between a transparent window and a segment of foil.

When the desired shade is attained, the stylist can remove individual foil segments, thus achieving an even coloration over all highlighted segments of the head.

Where more than one shade is desired, the foil can be color coded to distinguish the different shades. The no-slip adhesive allows the foil to be easily and quickly removed without discomfort to the client.

DESCRIPTION OF THE PREFERRED EMBODIMENT

Figure 1:
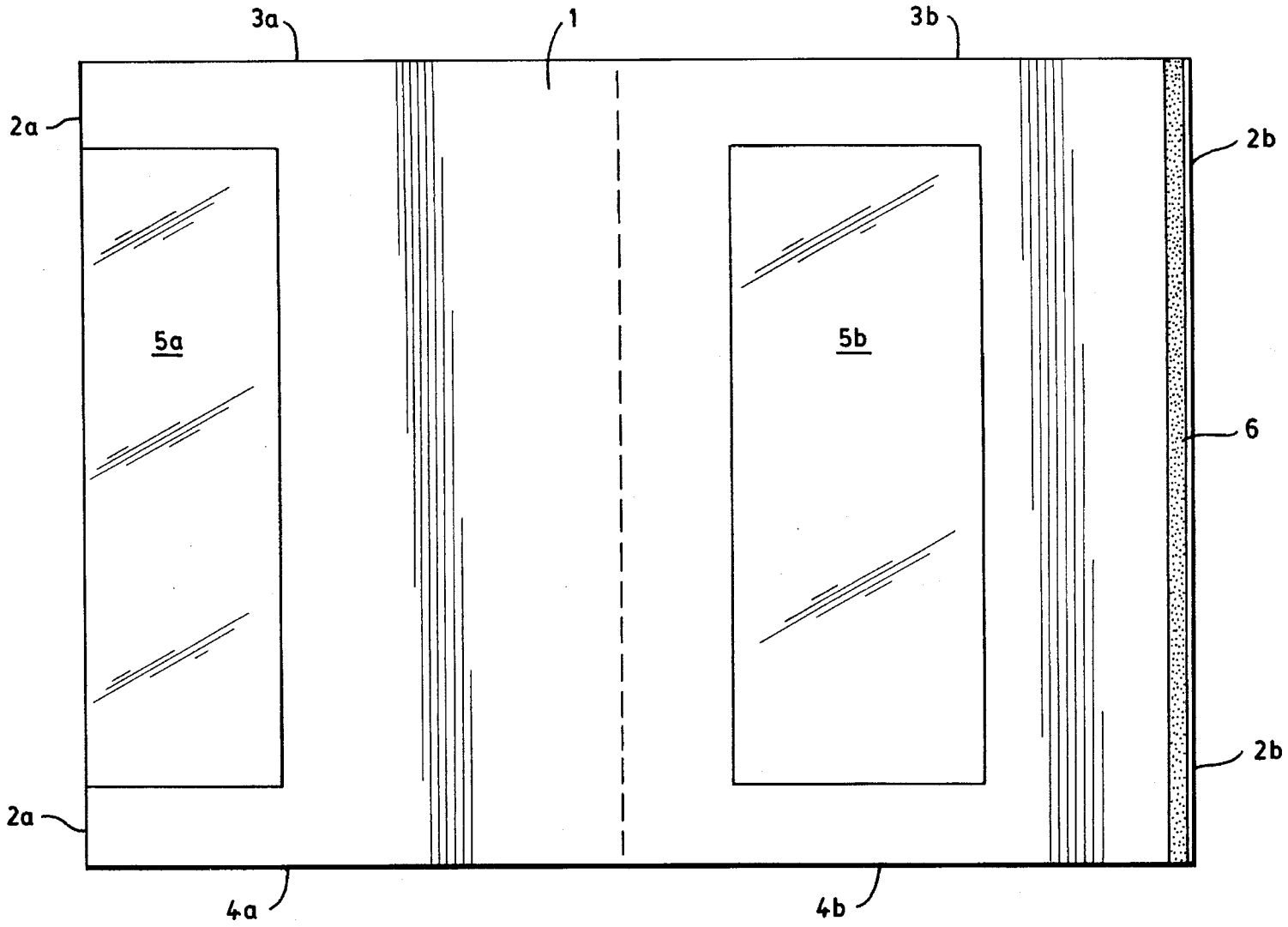
FIG. 1 is a top view of the pre-cut "metallic" foil segment, showing two window panel cut-outs, as well as the fold having the no-slip adhesive.

In the preferred embodiment of FIG. 1, aluminum foil panel 1 is pre-cut into segments preferably, though not mandatorily, 5 inches by 8 inches. Opposing end 2*b* along the shorter (i.e, 5-inch) border of the rectangle, preferably though not mandatorily, has a 3/16 inch fold to prevent the color or bleach from running or bleeding. The other set of opposing ends 3*a*, 3*b*, 4*a*, and 4*b* shown in FIG. 1 are the longer (8 inch) ends or borders of the rectangle. Window panes 5*a* and 5*b* are cut out of panel 1 so as to be, preferrably though not mandatorily, the same size, (e.g., in the preferred embodiment, 2-inch by 1.75-inch). Pane 5*a* is cut out of end 2*a*. Pane 5*b* is approximately in the center of its half of panel 1, such that when panel 1 is folded in half, both panes 5*a* and 5*b* cover a piece of the foil. Panes 5*a* and 5*b* are covered with a transparent material such as cellophane. In the preferred embodiment, no-slip adhesive 6 is affixed to end 2*b*. The relative positioning of the two window panes is not critical, provided only that when panel 1 is folded in half, the two window panes are not aligned on top of each other, so as to ensure that each pane covers a segment of the foil.

Figure 2:
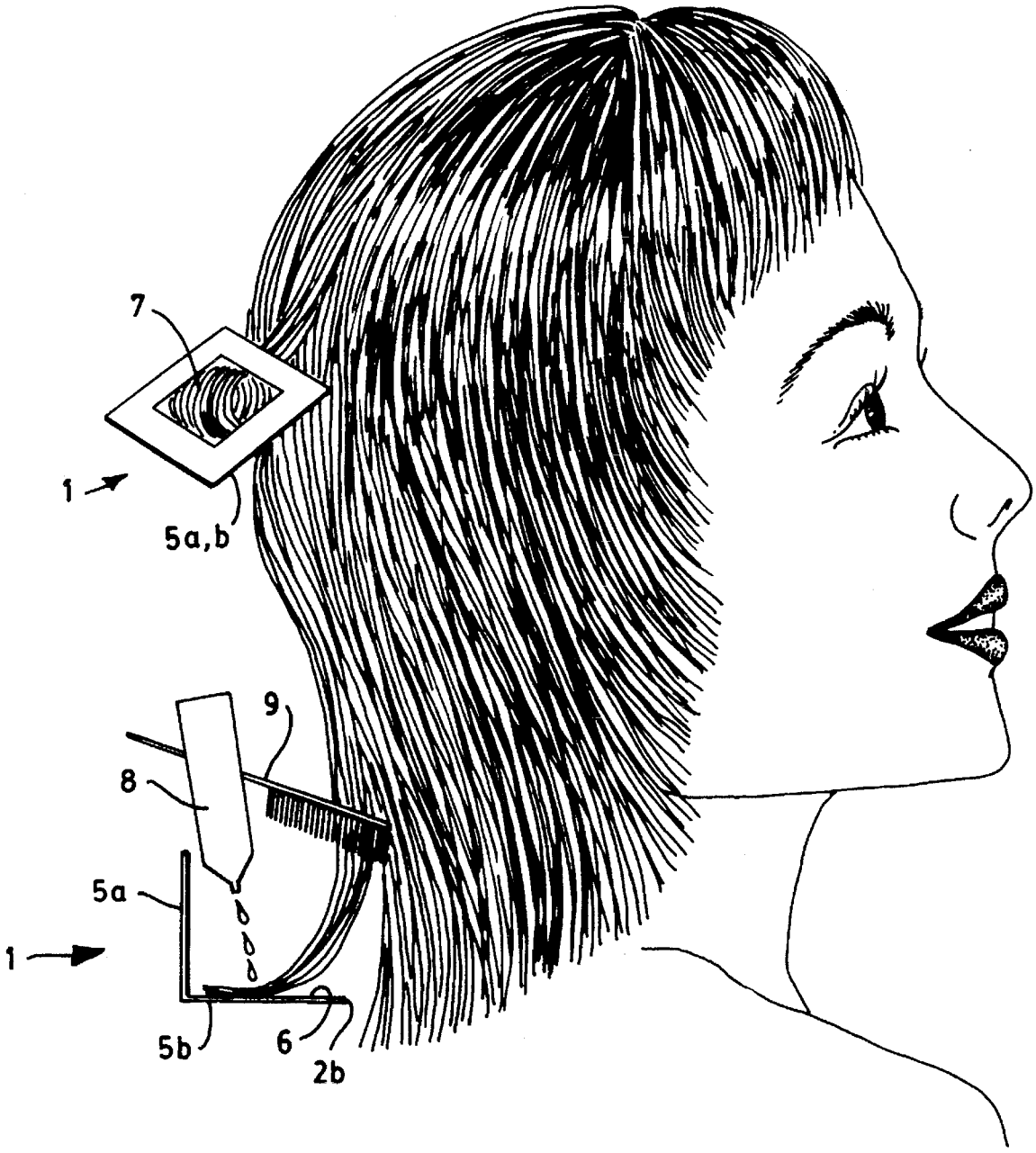
FIG. 2 is a back view of a human head showing the application of the foil segment in the process.

As shown in FIG. 2, the stylist pulls out a segment of hair, places end 2*b* of the foil against the client's head under the hair segment such that hair segment 7 substantially covers one half of panel 1, including window pane 5*b*. Hair segment 7 is gently held in place on the foil by adhesive 6. The color or bleach 8 is then applied to hair segment 7.

Panel 1 is then folded in half such that window panes 5*a* and 5*b* are on opposite sides of the folded panel and each pane covers a portion of the foil. Opposing ends 2*a* and 2*b* are aligned over each other and are held together by adhesive 6.

In the preferred embodiment, the two window panes allow a complete view of hair segment 7.

When panel 1 is folded in half, end 2*a* is aligned over end 2*b*, end 3*a* is aligned over end 3*b*, and end 4*a* is aligned over end 4*b*. As an added optimal feature, to further protect against bleeding or running of the liquid, ends 3*a* and 3*b* may be folded together, as may ends 4*a* and 4*b*.

The stylist now takes a second panel 1 and applies it to another segment of hair 7 elsewhere on the head, and repeats this process with other panels 1 on all desired areas of the head.

This configuration is particularly suited for darker hair or for hair that normally takes longer to develop because hair segment 7 is sandwiched between the cellophane window panels and the aluminum foil, creating a heating effect and thus shortening the developing time. Although this same result may be obtained with only one window covering essentially one-half of foil panel 1, the use of two window panes on opposite sides of panel 1 when it is folded in half is preferred, as the hair stylist can view the hair from either side of panel 1 to monitor its developing.

Concurrent with affixing additional panels 1 to the head, the stylist from time to time checks the color setting of the hair segments 7 which were previously highlighted, and removes those panels 1 where the hair coloration or bleaching has properly set. Hair segments 7 are simply removed from the panels 1 by opening ends 3*a, b* and 4*a, b*; then opening ends 2*a* and 2*b*. The colored or bleached hair segment 7 is then gently detached from adhesive 6. The entire hair is then washed and dried, resulting in a head of hair that is evenly highlighted. Used aluminum foil panels 1 are then disposed of.

As an optional feature, panels 1 may be color coded where more than one shade or type of color or bleached is desired.

Further, the panels 1 need not be rectangular, but can be square, triangular or other shapes and any number of windows can be used, provided only that the window panes each cover a segment of the foil when panel 1 is folded. Also, panel 1 and window panes 5*a* and 5*b* are not limited to the dimensions given but can be cut to other dimensions as desired.

Figure 3:
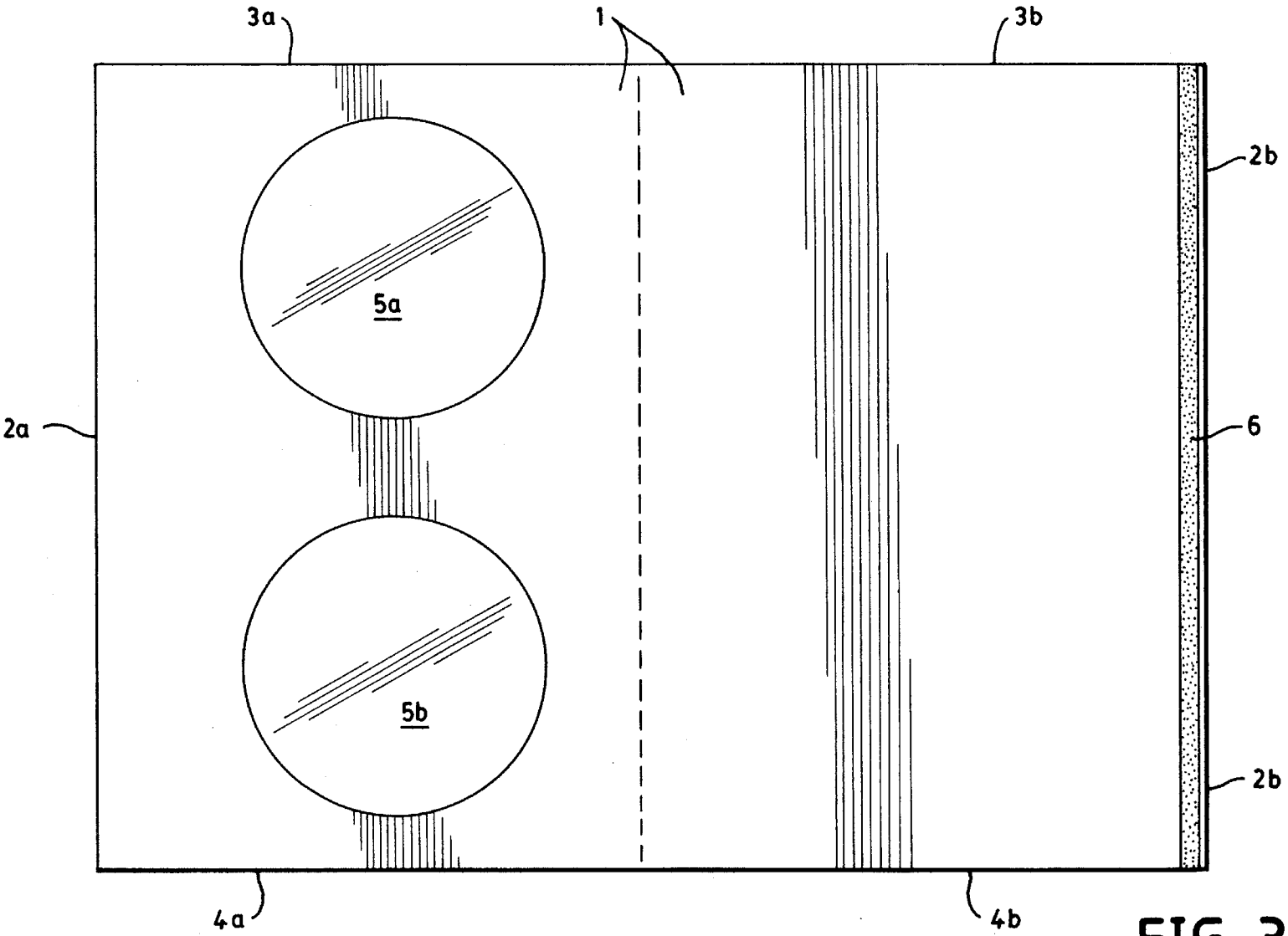
FIG. 3 is a top view of the metallic foil segment, showing two metallic portions, wherein one of the metallic portions has two window panel cut-outs.

FIG. 3 shows another variation wherein window panel 5*a* and 5*b* are both located on the same half or segment of panel 1. The panels may be of equal or different sizes. In this depictment, they are of equal size and are circular, although they may be of other shapes such as rectangles, oval, triangular, and so forth.

Figure 4:
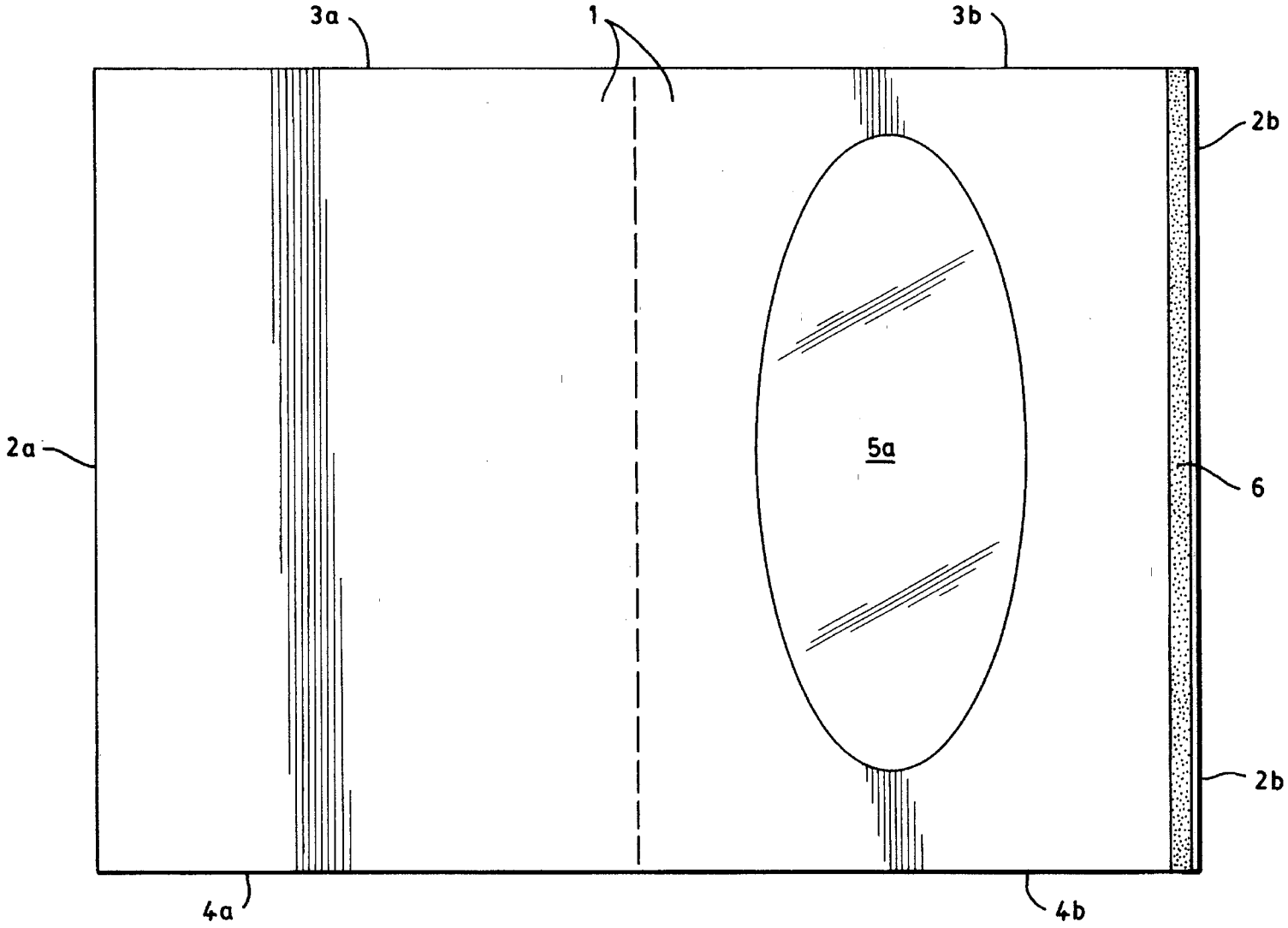
FIG. 4 is a top view of the metallic foil segment, showing two metallic portions wherein one of the metallic portions has one window panel cut-out.

FIG. 4. shows yet another variation wherein there is only one window panel 5*a* located on one half or segment of panel 1.

Figure 5:
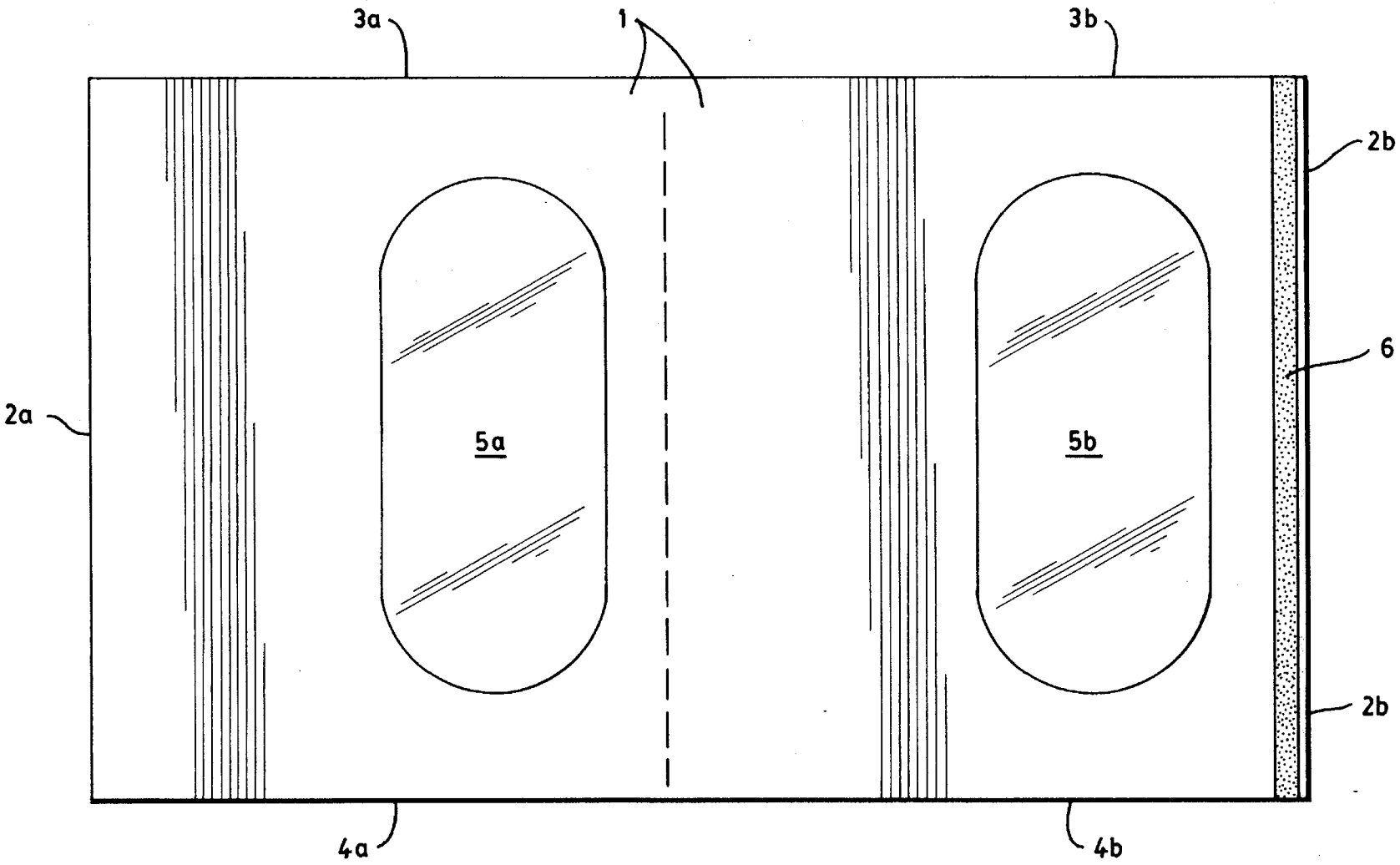
FIG. 5 is a top view of the metallic foil segment, showing two metallic portions, wherein each of the portions has an equal sized window pane of transparent material arranged such that when the foil segment is folded in half, one pane is aligned over a segment of foil and the other pane is aligned under a segment of foil.

FIG. 5. Is a top view of the metallic foil segment showing two window panes 5*a* and 5*b* cut out of panel 1 wherein panes 5*a* and 5*b* are of equal size and oval shape. Pane 5*a* is cut out of one - half or segment of panel 1 and pane 5*b* is cut out of the other half or segment of panel 1 and arranged such that when panel 1 is folded in half, both panes 5*a* and 5*b* cover a piece of the foil. In all cases, the panes are covered with a transparent material such as cellophane.

Figure 6:
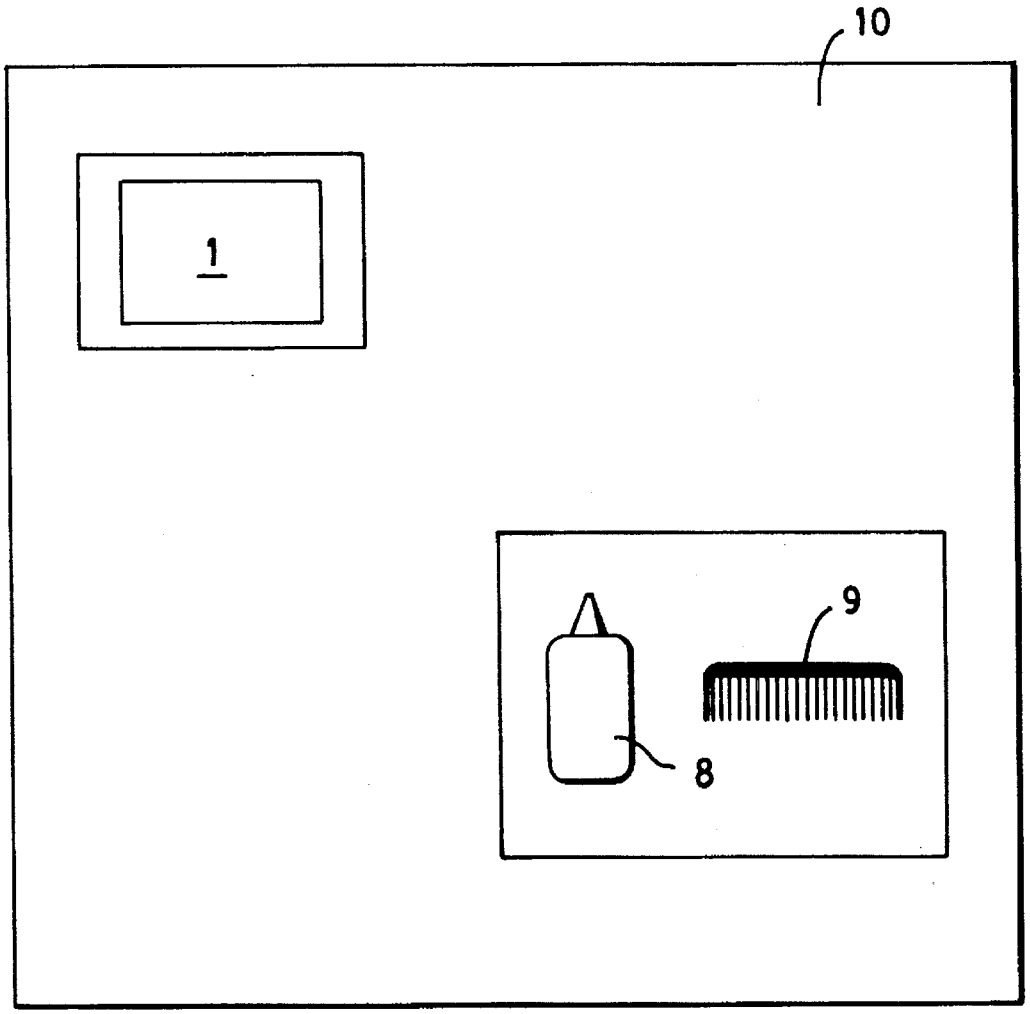
FIG. 6 is a view of the kit.

As shown in FIG. 6 the kit comprises the foil panel 1 and at least one transparent window in accord with the teaching of the invention as described herein, means for pulling out the segment of hair to be highlighted such as comb or brush 9, and a container of hair coloring or bleaching liquid 8. The kit can be packaged in a container 10 as shown. The container may be of any size shape or material.

The invention will also work without the adhesive, although, as aforementioned, the adhesive is preferred to prevent or minimize possible bleeding, for helping to hold the hair in place, and for ease of removing the hair when the coloring or bleaching effect is achieved.

The foil may be sold separately or packaged as part of a kit, including a package of foil and a comb and/or brush 9 to pull out the hair segment to be highlighted and placed on the foil as aforementioned. The kit may contain bottles of hair coloring or bleach although hair stylists may well prefer to mix their own in accord with a client's particular coloring needs.

It is to be understood that the above description pertains to an example of the preferred embodiment of the present invention and is intended as illustrative rather than limiting. The invention is to be defined therefore not by the preceding description but by the claims that follow.

What is claimed is:

1. A product for highlighting hair through foiling, comprising:

a segment of metallic foil, having a first foil segment portion and a second foil segment portion, said first foil segment portion disposed on top of said second foil segment portion to form a sandwich within which a segment of hair can be retained, said first foil segment portion having at least one window pane of a transparent material for viewing said retained hair segment, said second foil segment portion having a surface, a portion of which surface is engageable with said retained hair segment for imparting heat to said retained hair segment, said engageable portion of said surface substantially underlying said at least one window pane when said first foil segment portion is disposed on top of said second foil segment portion, said segment of metallic foil having oppositely arranged first and second ends, said ends being foldable one over the other when said first foil segment portion is disposed on top of said second foil segment portion.

2. The product of claim 1 wherein no-slip adhesive is affixed to at least one of the ends of said metallic foil segment.

3. The product of claim 1 wherein said first foil segment portion of metallic foil has at least two window panes.

4. A product for highlighting hair through foiling, comprising:

a rectangular shaped segment of metallic foil having two equal-sized window panes of a transparent material arranged on said foil such that when said foil is folded in half, the two panes are located on opposite sides of said foil so that one pane is aligned over a segment of foil and the other pane is aligned under a segment of foil, and further having a pair of longer ends opposite each other, and a pair of shorter ends opposite each other;

a fold at at least one of said two shorter ends; and no-slip adhesive material affixed to at least one of said shorter ends.

5. A method for highlighting hair, comprising:

providing a segment of metallic foil having at least one window pane of a transparent material, and having a first set of oppositely arranged ends, and a second set of oppositely arranged ends;

arranging said at least one pane on said foil such that when said foil is folded in half, said at least one pane will be positioned upon said foil;

folding both of said ends in said first set to form a border on each end;

affixing a no-slip adhesive material to at least one of said ends in said first set;

pulling out that segment of hair from a head that is to be highlighted;

placing the adhesive end of said foil against the head under said hair segment;

placing said hair segment on the foil such that it rests on the adhesive and covers, at least partially, said at least one pane;

applying highlighting liquid;

folding said foil in half such that said at least one pane is positioned upon said foil;

folding the other end of said second set over itself;

repeating the above steps for other segments of foil;

observing from time to time said hair segment in each of said foils by viewing through said panes;

removing each of said hair segments from each of said foils when the color or bleach is observed to be properly set; and washing and drying said hair.

6. A kit for highlighting hair, comprising:

a segment of metallic foil, having a first portion and a second portion, said first portion disposed on top of said second portion to form a sandwich within which hair can be retained, said first portion having a least one window pane of a transparent material for viewing said retained hair, said second portion having a surface, a portion of which surface is engageable with said retained hair for imparting heat to said retained hair, said engageable portion of said surface substantially underlying said at least one window pane when said first portion is disposed on top of said second portion, said segment of metallic foil having oppositely arranged first and second ends, said ends being foldable one over the other when said first portion is disposed on top of said second portion; no-slip adhesive affixed to at least one of said ends of said segment; and, means for pulling out a segment of hair to be highlighted and placing said hair segment on said adhesive.

7. The kit of claim 6 wherein said means for pulling out said hair segment and placing it on said adhesive is a brush and a comb.

8. The kit of claim 6 further comprising a container of highlighting liquid.

9. A product of highlighting hair through foiling, said product comprising:

a segment of metallic foil having a first portion and a second portion, said first portion disposed on top of said second portion to form a sandwich within which hair is retained and at least one window pane of transparent material for viewing said hair, positioned on at least one of said first or said second portions, said at least one window pane being disposed over said metallic foil.

10. The product of claim 9 wherein said segment of metallic foil has a fold along at least a portion of its periphery.

11. The product of claim 10 wherein said segment of metallic foil has no-slip adhesive affixed to at least a portion of said periphery.

12. A product for highlighting hair through foiling, comprising:

a segment of metallic foil, having a first portion and a second portion, said first portion disposed on top of said second portion to form a sandwich within which hair can be retained, at least one of said portions having at least one window pane of transparent material for viewing said hair, said at least one window pane being disposed over said metallic foil.

* * * * *